US008356462B2

(12) United States Patent
Conti

(10) Patent No.: US 8,356,462 B2
(45) Date of Patent: Jan. 22, 2013

(54) MACHINE FOR MAKING PODS CONTAINING INFUSION PRODUCTS

(75) Inventor: Roberto Conti, Imola (IT)

(73) Assignee: IMA Flavour S.R.L., Ozzano Emilia (IT)

( * ) Notice: Subject to any disclaimer, the term of this patent is extended or adjusted under 35 U.S.C. 154(b) by 419 days.

(21) Appl. No.: 12/742,393

(22) PCT Filed: Nov. 7, 2008

(86) PCT No.: PCT/IB2008/054661

§ 371 (c)(1), (2), (4) Date: May 11, 2010

(87) PCT Pub. No.: WO2009/063370

PCT Pub. Date: May 22, 2009

(65) Prior Publication Data

US 2010/0256797 A1 Oct. 7, 2010

(30) Foreign Application Priority Data

Nov. 13, 2007 (IT) ..... BO2007A0749

(51) Int. Cl.

| | |
|---|---|
| ***B65B 29/02*** | (2006.01) |
| ***B65B 9/04*** | (2006.01) |
| ***B65B 11/50*** | (2006.01) |
| ***B65D 85/804*** | (2006.01) |

(52) U.S. Cl. ..... 53/553; 206/5; 426/77

(58) Field of Classification Search ..... 53/553, 53/555; 206/0.5; 426/77; *B65B 29/02, 9/04, B65B 11/50; B65D 85/804*

See application file for complete search history.

(56) References Cited

U.S. PATENT DOCUMENTS

| | | | | |
|---|---|---|---|---|
| 4,446,158 | A * | 5/1984 | English et al. | 426/77 |
| 6,777,007 | B2 * | 8/2004 | Cai | 206/0.5 |
| 7,846,485 | B2 * | 12/2010 | Blanc et al. | 426/77 |
| 2004/0005384 | A1 | 1/2004 | Cai | |
| 2006/0201113 | A1 * | 9/2006 | Conti | 53/553 |
| 2007/0017825 | A1 | 1/2007 | Rapparini | |
| 2007/0130882 | A1 * | 6/2007 | Conti | 53/553 |
| 2009/0022855 | A1 * | 1/2009 | Steenhof et al. | 426/78 |
| 2009/0173642 | A1 * | 7/2009 | Blanc et al. | 206/0.5 |

FOREIGN PATENT DOCUMENTS

| | | | |
|---|---|---|---|
| CA | 2 072 300 | C | 1/1993 |
| JP | 2000302101 | A * | 10/2000 |
| WO | WO 01/34475 | A1 * | 5/2001 |
| WO | 2004/018326 | A1 | 3/2004 |
| WO | 2005/047111 | A1 | 5/2005 |
| WO | WO 2007090485 | A1 * | 8/2007 |

* cited by examiner

*Primary Examiner* — Stephen F Gerrity
(74) *Attorney, Agent, or Firm* — Pearne & Gordon LLP

(57) ABSTRACT

A machine for making pods (2) containing products for infusion including a first roll (3) for feeding a first web (4) of filtering paper material along a predetermined path (P), a second roll (5) for feeding a second web (6) of filtering paper material along a predetermined path (P'), a station (7) for dispensing and successively placing individual charges (8) of product on the first web (4), and a joining station (11) for superposing and joining the first web (4) and the second web (6) in such a way as to form a continuous succession (12) of pods (2); the machine also includes, upstream of the dispensing station (7), a magazine (13) for successively feeding a series of elements (14) for containing the infusion product and a station (21) for forming impressions in the first web (4) and positioning the elements (14) thereon.

4 Claims, 3 Drawing Sheets

MACHINE FOR MAKING PODS CONTAINING INFUSION PRODUCTS

TECHNICAL FIELD

This invention relates to a machine for making pods containing products for infusion.

In particular, the invention can be advantageously applied to the production of pods containing a product for infusion in powder form, preferably cocoa, chocolate coffee, even mixed with powdered milk or the like, which the present specification expressly refers to but without limiting the scope of the invention.

BACKGROUND ART

As is known, pods used to brew a single serving of a beverage generally consist of two portions of filter paper placed one over the other and sealed.

These two portions enclose centrally between them a charge of one of the above mentioned products, in most cases substantially circular in shape.

Pods of this kind are made in specific machines which comprise:

- a station for feeding a first web of filter paper;
- a station for making a succession of circular impressions in the web;
- a feed station for filling each impression made in the web with a product charge through a specific metering station;
- a station for joining the first web of filter paper (having the product-filled impressions in it) to a second covering web fed at a respective sealing station located downstream of the metering station, again relative to the direction of rotation of the carousel;
- a station for cutting the pods thus made and downstream of which the finished pods are transferred to a packaging station.

Single-brew, disposable pods of this type are not free of disadvantages.

In particular, if the product for infusion is not very compact (typically the case of mixtures of two different products, such as chocolate, or coffee, and powdered milk), the resulting infusion is not usually up to required standards (in terms of flavour, for example).

To overcome this problem, an element like the one shown in FIG. 2 has been developed.

This element is a disc of plastic material having a plurality of internal cavities and must be inserted between the first and the second layer of filter paper.

The infusion product is placed in the cavities inside the disc. The cavities allow the product to be spread evenly over the entire inside surface of the disc.

The disc also enables the pod to remain compact even if the infusion product it contains is extremely inhomogeneous.

At present, automatic machines for making pods containing these discs of food-safe plastic do not exist.

DISCLOSURE OF THE INVENTION

This invention therefore has for an aim to provide a machine for making pods containing a product for infusion, in particular a product in powder form, preferably a mixture of cocoa and milk, each pod being having inside it the above mentioned plastic disc.

The technical characteristics of the invention according to the aforementioned aim may be easily inferred from the contents of the appended claims, especially claim 1, and preferably any of the claims that depend, either directly or indirectly, on claim 1.

BRIEF DESCRIPTION OF THE DRAWINGS

The advantages of the invention will become more apparent from the following detailed description provided by way of example with reference to the accompanying drawings which illustrate a preferred, non-restricting embodiment of the invention and in which.

DETAILED DESCRIPTION OF THE PREFERRED EMBODIMENTS OF THE INVENTION

Figure 1:
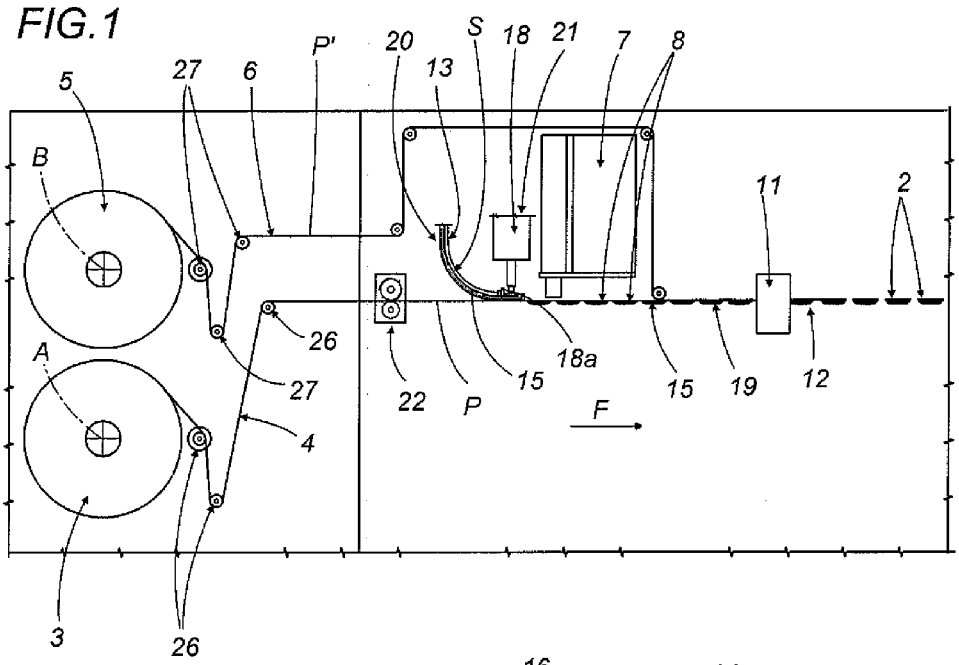
FIG. 1 is a schematic side elevation view of a machine according to this invention for making pods containing products for infusion.

With reference to the accompanying drawings, in particular FIG. 1, the numeral 1 denotes in its entirety a machine for making pods 2 containing products for infusion, Insofar as is relevant to this specification, the machine 1 essentially comprises: a first roll 3 for feeding a first web 4 of filtering paper material (filter paper) rotatable about a respective axis A; and second roll 5 for feeding a second web 6 of filtering paper material rotatable about a respective axis B.

The first web 4 of filtering paper material fed from the first roll 3 is fed through the machine 1 along a respective path P in the direction indicated by the arrow F in FIG. 1.

The second web 6 of filtering paper material fed from the second roll 5 is fed through the machine 1 along a respective path P' in the direction indicated by the arrow F in FIG. 1.

The machine 1 also comprises a station 7 for dispensing and successively placing individual charges 8 of the infusion product on the first web 4.

Each charge 8 defines the contents of a respective pod 2.

In the embodiment illustrated in the accompanying drawings (purely by way of non-limiting example), at the dispensing station 7, infusion product charges 8 are placed side by side in pairs 9 on respective portions 10 of the first web 4 in succession as the web 4 is fed forward and in a direction transversal to the feed direction of the web itself.

Downstream of the dispensing station 7, the machine 1 comprises means 11 for superposing and joining the first web 4 and the second web 6 to each other to form a continuous succession 12 of pods 2.

Figure 2:
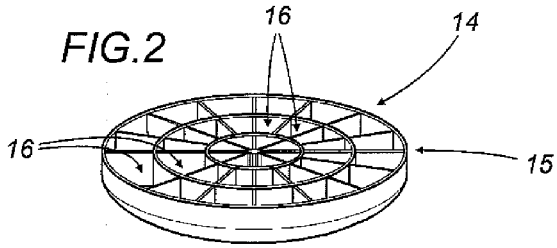
FIG. 2 illustrates a detail of a pod made in the machine according to the invention.
Figure 5:
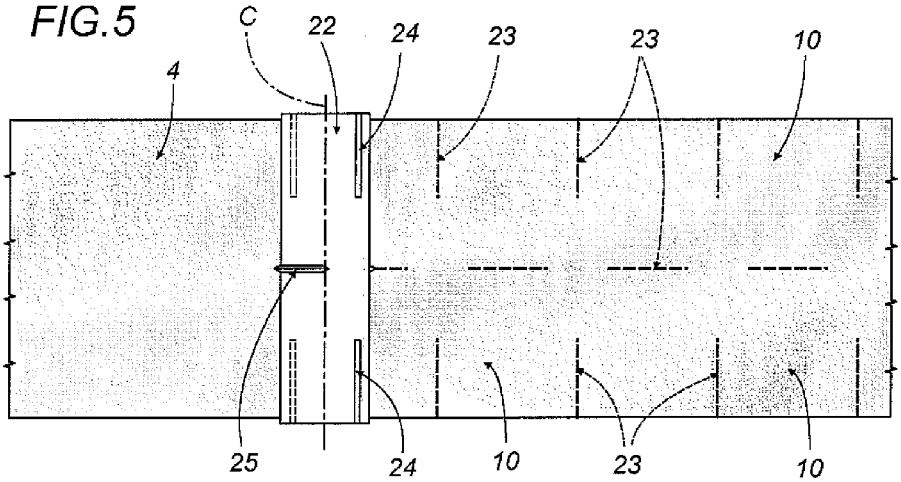
FIG. 5 is a top plan view of a third enlarged detail of the machine of FIG. 1.

Upstream of the dispensing station 7, the machine 1 also comprises a magazine 13 accommodating two rows, side by side, of containment elements 14 in the form of discs 15 made of a plastic material and each having a plurality of internal cavities 16 (FIG. 2).

The discs 15 are designed to be placed in succession on the first web 4 at the above mentioned portions 10 of the first web 4 where the infusion product is dispensed.

The magazine 13 is of the type comprising curved chute means S which have a substantially vertical initial portion 13*a* and a substantially horizontal end portion 13*b* tangent to the path P and which are designed to allow a succession of discs 15 to be fed downwards. Air jet means (of customary type and not illustrated) are associated with the chute means S and act in conjunction with the latter to facilitate feed of the discs 15 down along the chute means S themselves.

Figure 4:
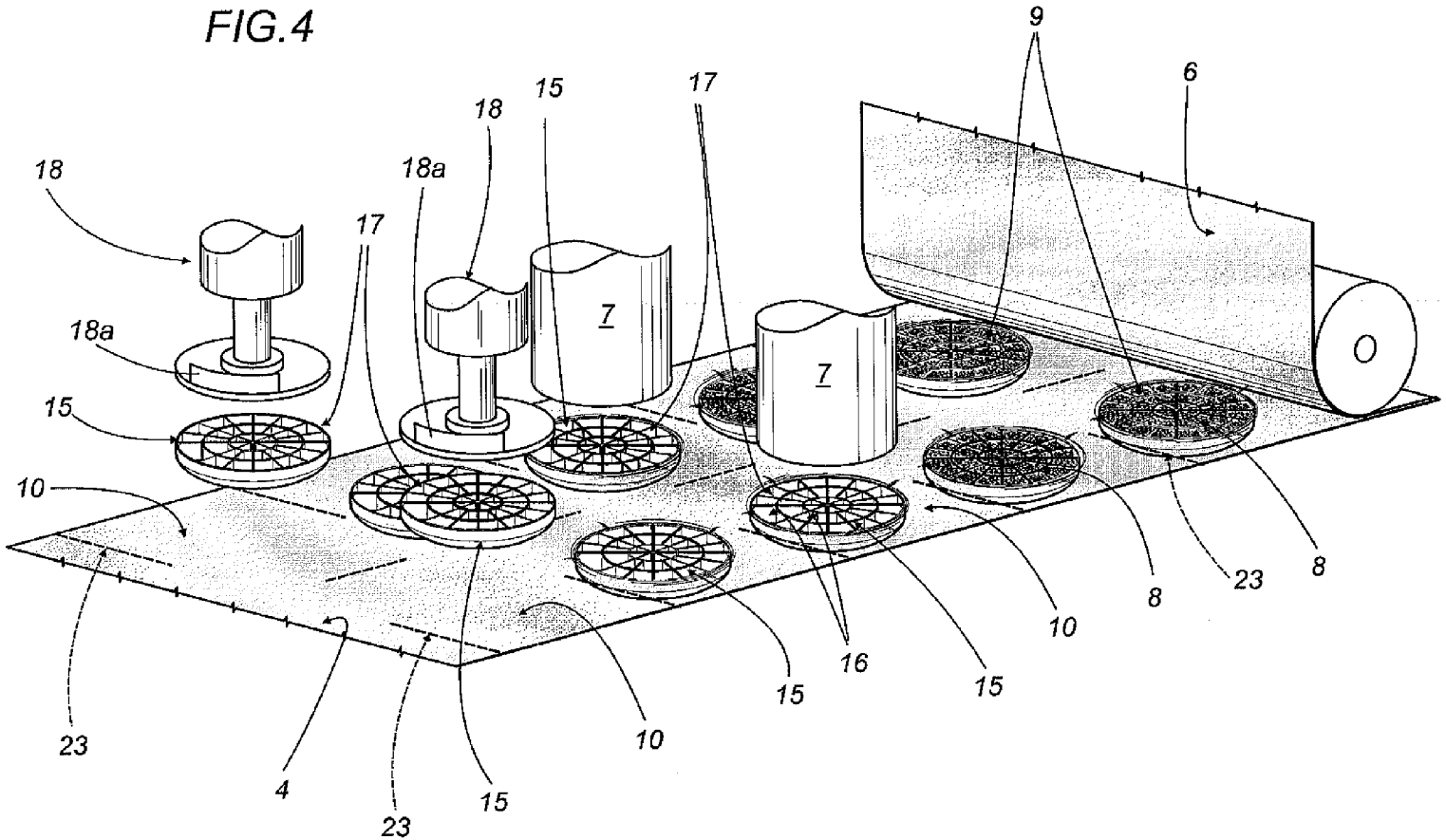
FIG. 4 is a schematic perspective view of a second enlarged detail of the machine of FIG. 1.

In use, the chute means S and the air jets act in conjunction to downwardly feed and place each pair 17 of discs 15 under a respective pair of pistons 18 mounted side by side in a direction transversal to the feed direction of the first web, as shown in FIG. 4.

Each piston 18 moves between a raised non-operating position and a lowered position at which it impinges on the first web 4. Each piston 18, as it moves down vertically, presses a respective disc 15 lying under it against the first web 4 in such a way that the disc 15 itself forms an impression in it. Further, as illustrated better in FIGS. 1 and 3, each piston 18 is fitted at its rear end, relative to the feed direction (arrow F) along the path P, with a radial protuberance 18*a* constituting means for stopping the succession of discs 15 during the downstroke of the piston 18 itself.

In this way, the disc 15 forms in the first web 4 an impression 19 in which the disc 15 itself remains when the piston 18 returns to the raised position.

Each disc 15 placed inside an impression 19 is interposed between the first web 4 and the second web 6 of filtering paper material and forms a site 102 for emplacement of a product charge 8.

In practice, the magazine 13 constitutes means 20 for feeding in succession a series of elements 14 for containing the infusion product.

The means S and the piston 18 in turn constitute means 21 for forming impressions in, and placing the discs 15 on, the first web 4.

Figure 3:
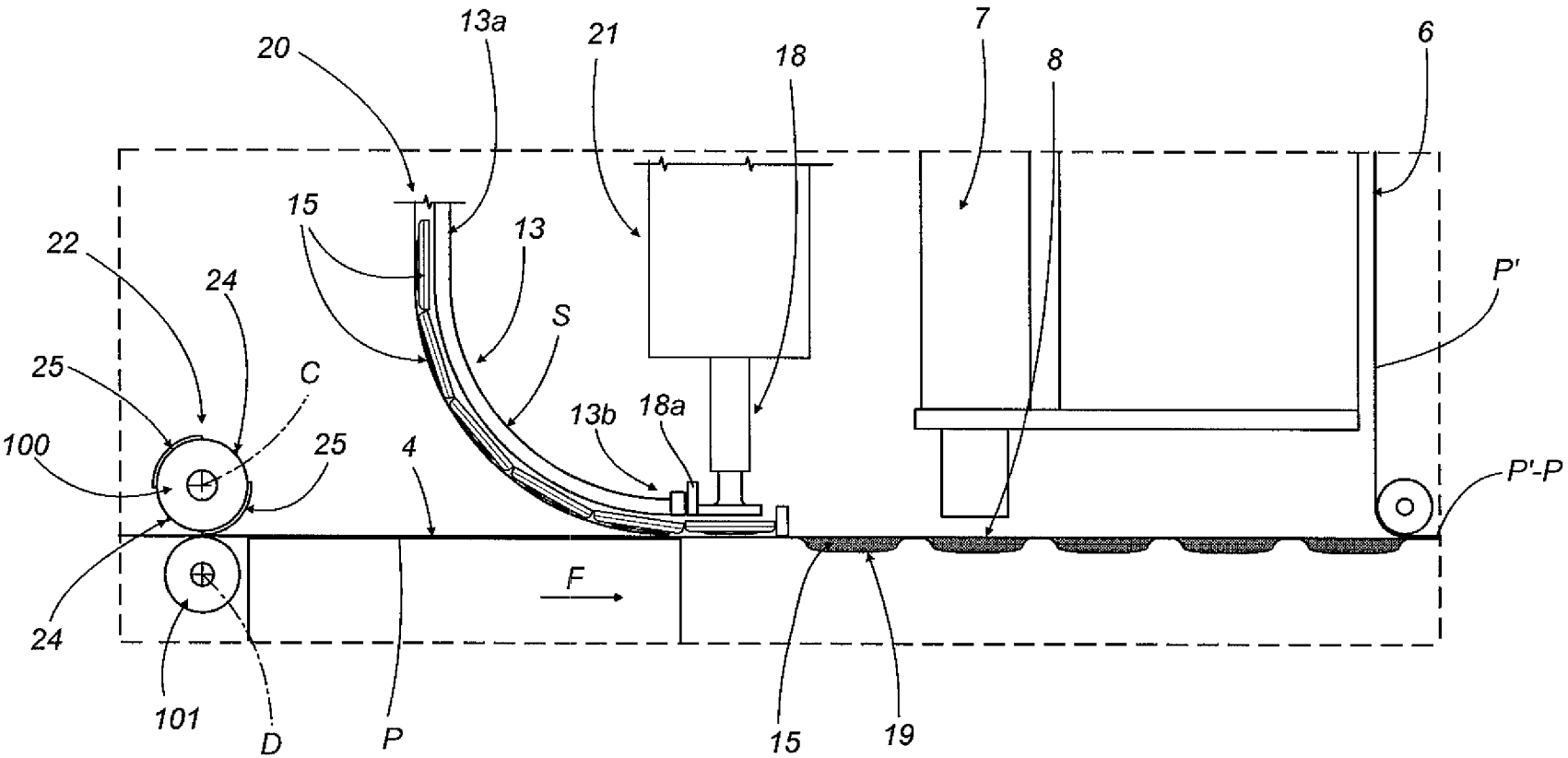
FIG. 3 is a side view of a first enlarged detail of the machine of FIG. 1.

Upstream of the magazine 13 and of the piston 18, as illustrated in FIGS. 1 and 3, the machine 1 comprises means 22 for scoring the first web 4, designed to make a plurality of crease lines on the first web 4 in directions respectively parallel and transversal to the first web 4 itself, in such a way as to surround each of the portions 10 of the first web 4 where the discs 15 are placed, as illustrated in FIG. 3.

Again with reference to FIGS. 1 and 3, the scoring means 22 comprise a first, upper roller 100 and a second, lower roller 101 placed face to face and between which the first web 4 advances.

The rollers 100 and 101 revolve about an axis C and an axis D, respectively.

The upper roller 100 comprises two peripheral blades 24 positioned transversally to the feed direction of the web 4 and two central blades 25 positioned parallel to the feed direction of the web 4 in such a way as to form crease lines 23 as illustrated in FIG. 3.

In use, the first roll 3 revolves abut its axis A (in a clockwise direction, looking at FIG. 1), so as to feed the first web 4 along the path P through a plurality of feed pulleys 26.

At the same time, the second roll 5 revolves abut its axis B (in a clockwise direction, looking at FIG. 1), so as to feed the second web of filtering paper material along the path P' through a plurality of feed pulleys 27.

As the first web 4 advances, the scoring means 22 make the crease lines 23 on it.

More in detail, with reference to FIG. 3, at each portion 10 of the web 4 designed to receive a pair 17 of plastic discs 15 and a pair 9 of infusion product charges 8, four crease lines 23 transversal to the longitudinal extension of the web 4 and one longitudinal crease line 23 are made.

At the zone under the magazine 13, a pair 17 of discs 15 is placed on the first web 4 by the magazine 13 and moved under the pistons 18.

At this point, each piston 18 is actuated and starts moving towards its lower position, thereby pushing a disc 15 against the top face of the first web 4.

Under the action of the piston 18, the disc 15 forms an impression 19 in the first web 4 which captures and holds the disc 15 when the piston 18 returns to its raised position.

Advantageously, the crease lines 23 enable the piston 18 to press the discs 15 into the first web 4 without tearing the latter, thanks to the elastic action provided by the crease lines 23 themselves.

Next, the web 4 advances towards the dispensing means 7 which place an infusion product charges 8 of each pair 9 into a respective disc 15 of each disc pair 17 located in the impressions 19 in the first web 4.

As shown in FIG. 1, the first web 4 with a succession of pairs 17 of filled discs 15 on it advances to the point where the path P meets the path P' and the second web 6 is laid over the first web 4.

At this point, the superposing and joining means 11 seal the two webs together to form the above mentioned continuous succession 12 of pods 2.

Downstream of the superposing and joining means 11 there are cutting means, of known type and therefore not illustrated, which divide the continuous succession 12 of pods 2 into a plurality of single pods 2 each containing a plastic disc 15 filled with infusion product.

The invention described above is susceptible of industrial application and may be modified and adapted in several ways without thereby departing from the scope of the inventive concept. Moreover, all the details of the invention may be substituted by technically equivalent elements.

The invention claimed is

1. A machine for making pods (2) containing products for infusion, the machine comprising at least: means (3) for feeding at least one first web (4) of filtering paper material along a predetermined path (P); means (5) for feeding at least one second web (6) of filtering paper material along a predetermined path (P'); a station (7) for dispensing and successively placing individual charges (8) of product on the first web (4), said charges (8) constituting the contents of the pods (2); means (11) for superposing and joining the first web (4) and the second web (6) to form a continuous succession (12) of pods (2); the machine further comprising, upstream of the dispensing station (7), relative to the path (P), means (20, 13, S) for successively feeding a series of elements (14) for containing the infusion product; and means (21) for forming impressions in the first web (4) and positioning the elements (14) thereon; each of the elements (14) being interposed between the first web (4) and the second web (6) to define a site (102) on the first web on which a charge (8) can be placed, wherein the positioning and impression forming means (21) comprise at least one piston (18) designed to push each of the elements (14) against a respective portion (10) of the first web (4) to form an impression in the portion (10) and to position each of the elements (14) inside a respective impressed portion (10).

2. The machine according to claim 1, characterized in that the means (20, 13, S) for successively feeding the containment elements (14) comprise a magazine (13, S) with a chute for containing the elements (14) in stacked form.

3. The machine according to claim 1, characterized in that the machine comprises means (22) for scoring the first web (4) to make a plurality of crease lines (23) on the web (4), said crease lines (23) being made around each impressed portion (10) on the web (4).

4. The machine according to claim 3, characterized in that the scoring means (22) are located upstream of the positioning and impression forming means (21) to prevent the positioning and impression forming means (21) themselves from tearing the first web (4).

* * * * *